US006604820B1

(12) United States Patent
Fukuda

(10) Patent No.: US 6,604,820 B1
(45) Date of Patent: Aug. 12, 2003

(54) INK-JET TYPE IMAGE FORMING DEVICE

(75) Inventor: Michitaka Fukuda, Tokyo (JP)

(73) Assignee: Canon Finetech Inc., Ibaraki (JP)

( * ) Notice: Subject to any disclaimer, the term of this patent is extended or adjusted under 35 U.S.C. 154(b) by 0 days.

(21) Appl. No.: 09/856,570

(22) PCT Filed: Dec. 7, 1999

(86) PCT No.: PCT/JP99/06839

§ 371 (c)(1),
(2), (4) Date: May 22, 2001

(87) PCT Pub. No.: WO00/34049

PCT Pub. Date: Jun. 15, 2000

(30) Foreign Application Priority Data

Dec. 7, 1998 (JP) ..... 10-363814

(51) Int. Cl.[7] ..... B41J 2/01
(52) U.S. Cl. ..... 347/104; 347/102
(58) Field of Search ..... 347/102, 101, 347/104; 271/226, 83; 400/627, 621

(56) References Cited

U.S. PATENT DOCUMENTS

| | | | | |
|---|---|---|---|---|
| 4,975,780 A | | 12/1990 | Kuboki | 358/296 |
| 5,576,754 A | | 11/1996 | Korem | 347/262 |
| 5,838,354 A | | 11/1998 | Yamada et al. | 347/101 |
| 5,896,154 A | * | 4/1999 | Mitani et al. | 347/102 |
| 6,173,551 B1 | * | 1/2001 | Bowman, Jr. et al. | 53/131.4 |
| 6,234,472 B1 | * | 5/2001 | Juan | 271/194 |

FOREIGN PATENT DOCUMENTS

| | | | |
|---|---|---|---|
| EP | 0 771 652 | | 5/1997 |
| JP | 3-270 | * | 1/1991 |
| JP | 3-251473 | | 11/1991 |
| JP | 3251473 | * | 11/1991 |
| JP | 5-8466 | | 1/1993 |
| JP | 8-112950 | | 5/1996 |
| JP | 8-156351 | | 6/1996 |

OTHER PUBLICATIONS

Patent Abstracts of Japan, vol. 1998, No. 11 Sep. 30, 1998, JP 10 157026 A (Abstract) Jun. 16, 1998.
Patent Abstracts of Japan, vol. 13, No. 234 (M–832) May 30, 1989, JP 01 045668 A (Abstract) Feb. 20, 1989.

* cited by examiner

*Primary Examiner*—Lamson Nguyen
*Assistant Examiner*—Ly Tran
(74) *Attorney, Agent, or Firm*—Dellett and Walters

(57) ABSTRACT

An ink-jet type forming device comprising a suction fan (11) for sucking from below a platen (12), a print medium (14) that is being conveyed on the platen (12), and a variable controller for variably controlling the suction force of the suction fan (11) under a predetermined condition. The variable controller that, in each scanning of a head, recognizes presence and absence of the head within a printing region ranging from the printing start position to the printing end position and that controls the suction fan such that the suction force is lower when the head is outside the printing region than when it is within the printing region, as the predetermined condition. Alternatively, it includes a detector that recognizes the kind of a print medium that has been set and that controls the suction force of the suction fan according to the recognized kind of print medium, as the predetermined condition. Adjustment of the suction force of the suction fan lowers the load on a conveyance motor and generally reduces power consumption and noise.

13 Claims, 16 Drawing Sheets

FIG. 10

| ADDRESS | DATA | | |
|---|---|---|---|
| 400H | 08 | ···L-TIME DATA | PAPER A |
| 401H | 09 | ···CYCLE-TIME DATA | |
| 402H | 06 | ···L-TIME DATA | PAPER B |
| 403H | 09 | ···CYCLE-TIME DATA | |
| 404H | 05 | ···L-TIME DATA | PAPER C |
| 405H | 08 | ···CYCLE-TIME DATA | |
| ⋮ | | | |

INK-JET TYPE IMAGE FORMING DEVICE

TECHNICAL FIELD

The present invention relates to an ink-jet type image forming device, and more particularly to an ink-jet type image forming device having a suction fan for sucking a print medium (paper) onto a conveyance platen, capable of variably changing the suction force of the print medium as necessary.

BACKGROUND ART

Ink-jet type image forming devices include a printer, a plotter, a FAX, and so on. Some of these ink-jet type image forming devices have a fan disposed below the platen to turn the fan during a printing operation to suck a sheet of paper. The fan is provided to prevent the paper sheet from rising and to give a good print quality.

To drive the suction fan, a drive signal is assigned to a CPU port or an ASIC port, and this drive signal is turned on/off to drive the fan.

Actually, however, the suction force of the suction fan need not always be fully (100%) activated during a sequence of print operations. In some situations, the suction force, even if reduced, does not cause any quality problem.

However, the conventional suction fan is simply controlled in such a way that it is either on or off and, therefore, when the suction fan is on, the suction force is always constant (100%). This puts a large load on the paper conveyance motor and, at the same time, causes some power consumption and noise problems.

An image forming device using a roll paper as a print medium cuts the print medium when a print has been finished. At this time, a cut error could occur depending upon the type of a print medium, and this error sometimes causes a jam in cutting the print medium.

In addition, to prevent wet ink from staining a print image, the image forming device waits a while immediately after the completion of a printing until the ink dries, and then cuts the roll paper. This sometimes delays the start of the next printing.

In view of the foregoing, it is an object of the present invention to provide an ink-jet type image forming device that adjusts the suction force of the suction fan to reduce the load of the conveyance motor and, at the same time, to generally reduce power consumption and noise.

It is another object of the present invention to provide an ink-jet type image forming device that adjusts the suction force of the suction fan to prevent a print medium jam from occurring at a cut time.

It is still another object of the present invention to provide an ink-jet type image forming device capable of effectively reducing the time required for the ink to dry by adjusting the suction force of the suction fan.

DISCLOSURE OF INVENTION

The ink-jet type image forming device according to the present invention ejects ink from a head onto a print medium being conveyed on a platen to form an image, the head being scanned in a direction substantially at a right angle with a direction in which the print medium is conveyed, the device comprising a suction fan for sucking the print medium from below the platen; and variable-control means for variably controlling a suction force of the suction fan under a predetermined condition.

Thus, the variable controlling of the suction force, instead of simply turning on/off the suction fan, allows the suction fan to be controlled under the predetermined condition. As a result, the load of the conveyance motor is decreased and, at the same time, power consumption and noise are generally reduced.

The variable-control means may be implemented by a number-of-rotation control means for variably controlling a number of rotations of the suction fan. Alternatively, the variable-control means may be implemented by using a flow-path open/close unit disposed in a flow path of air sucked by the suction fan and capable of opening/closing the flow path at a variable open degree.

Preferably, the variable-control means dynamically controls the suction force of the suction fan during a printing operation. For example, the variable-control means has means for checking, during each head scanning, whether or not the head is within a print region ranging from a printing start position to a printing end position, and the suction force of the suction fan is controlled under the predetermined condition in such a way that the suction force of the suction fan exerted when the head is outside the print region is made lower than the suction force exerted when the head is in the print region. Variably controlling the suction force of the suction fan even during a printing operation allows the suction fan to be fine-tuned.

The variable-control means may include means for recognizing a type of the print medium that has been set and the suction force of the suction fan may be controlled according to the type of the recognized print medium. This allows the device to select the suction force suited for the type of print medium, as the predetermined condition.

When the image forming device includes a cutter unit for cutting a roll paper used as the print medium, the variable-control means may use a first suction force and a second suction force as the predetermined condition such that the first suction force is the suction force of the suction fan exerted when one band of printing is being performed by the scanning of the head, and the second suction force is the suction force of the fan exerted when the roll paper is cut by the cutter unit, the second suction force being lager than the first suction force. This increases the suction force of the print medium at a cut time and prevents a cut error and a cut-time jam. In this case, he second suction force of the suction fan may be controlled according to the type of the roll paper.

The image forming device may have a cutter unit for cutting a roll paper used as the print medium, and the variable-control means may maintain the suction force of the suction fan to be strong sufficient to retain a sheet of cut paper for a predetermined period of time even after the cutter unit has cut the roll paper and, after the predetermined period of time has elapsed, change the suction force of the suction fan to such an extent that the sheet of cut paper drops. In this case, the image forming device preferably includes a control means for moving a leading edge of the cut roll paper to a standby position for the next printing, immediately after the cutter unit has cut the print medium. Thus, retaining the sheet of cut paper with the suction fan allows the roll paper to be cut immediately after the completion of printing and, as a result, the leading edge of the roll paper to immediately stand by in the next printing start position. This effectively reduces the ink-drying wait time. Once the leading edge stands by for printing, a printing may be started even during the dry wait time to the extent that the leading edge of the roll paper does not reach the sheet of cut roll paper that is being retained.

The image forming device repeatedly alternates between one-band printing by the scanning of the head and one-band conveyance of the print medium after the one-band printing, and the variable-control means uses a first suction force and a second suction force as the predetermined condition such that the first suction force is the suction force of the suction fan exerted when one band of printing is being performed by the scanning of the head, and that the second suction force is the suction force of the fan exerted when the print medium is conveyed, the second suction force being smaller than the first suction force. This reliably makes the print medium flat during a printing operation, while reducing the conveyance load during the paper conveyance.

In this case and certain cases mentioned above, the suction fan may be rotated and controlled by a fan motor, and the image forming device may have a brake means for suppressing a rotation of the fan motor such that the variable-control means uses the brake means to decrease the suction force of the suction fan. This will enhance the responsibility of the suction force control.

BRIEF DESCRIPTION OF DRAWINGS

FIG. 10 is a diagram showing an example of duty-factor data for each medium stored in a ROM 25 in the second embodiment of the present invention.

BEST MODE FOR CARRYING OUT THE INVENTION

Now, preferred embodiments of the present invention will be described with reference to the drawings.

Figure 1:
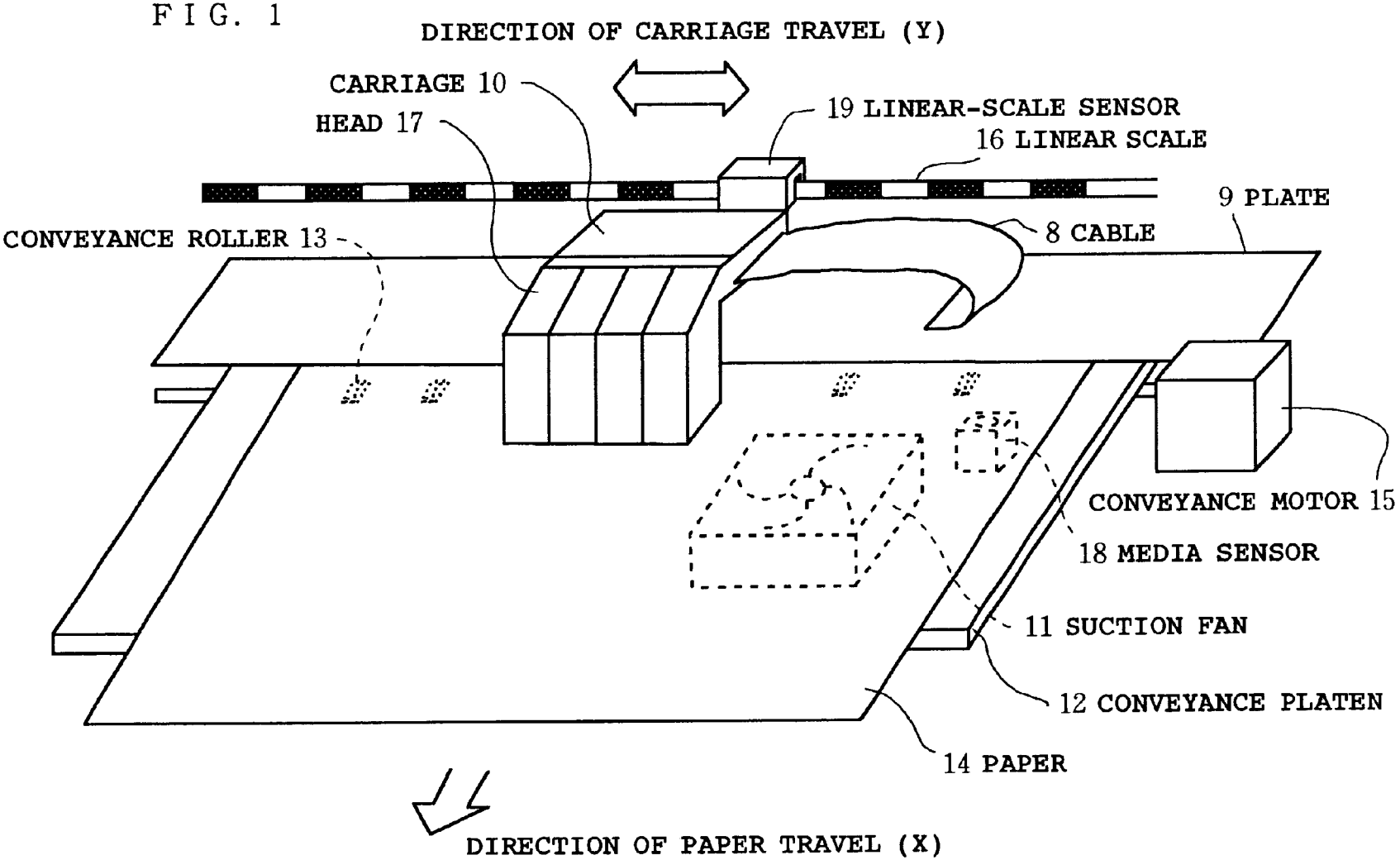
FIG. 1 is an external view of the main components (relating to carriage travel and paper conveyance) of an ink-jet printer as an example of an image forming device according to the present invention.

FIG. 1 is an external view of the main components (relating to carriage travel and paper conveyance) of an ink-jet printer as an example of an image forming device according to the present invention.

Referring to FIG. 1, a carriage 10 with a plurality of heads 17 mounted thereon travels back and forth in the direction of carriage travel (Y) along a guide rail, driven by an endless wire turned by a carriage motor (they are not shown in the figure). A linear scale sensor 19 on the carriage 10 senses the stripe patterns or slits equally-spaced on a linear scale 16 provided along the guide rail to find the current position of the carriage 10 (and the head 17). The position of the head may be detected not only by sensing the linear scale 16 but also with a rotary encoder or by monitoring the number of drive pulses from a carriage motor. In the figure, numeral 8 indicates a flat cable through which the electrical signals are sent to the head 17. This flat cable 8 is taken out from inside a plate 9.

On the other hand, a sheet of paper (print medium) on which the head 17 prints is conveyed on a conveyance platen 12 in the paper travelling direction (X), which is substantially at a right angle with the carriage travelling direction, by a conveyance motor 15 via conveyance rollers 13 and pinch rollers. (not shown in the figure). Disposed below the conveyance platen 12 is a suction fan 11 that sucks a sheet of paper 14 onto the surface of the conveyance platen 12 through air holes (not shown) provided in the platen 12. A medium sensor 18 provided in the conveyance path of the sheet of paper 14 checks if the paper has been set on the platen. In this embodiment, the medium sensor 18 is a reflective-type optical sensor.

Next, the control configuration of the suction fan 11 will be described with reference to FIG. 2. The overall operation of the printer is controlled by an MPU (microprocessor unit) 21. The MPU 21 contains a ROM 25, a general-purpose counter 26, and a PWM (Pulse Width Modulation) controller 22. The ROM 25 is a non-volatile memory in which the operation program of the MPU 21 and various types of constant data (including PWM duty-factor data) are stored. In this embodiment, the general-purpose counter 26 is used to count the pulses sensed by the linear scale sensor 19. That is, the value in the general-purpose counter 26 increments or decrements in response to the output signal from the linear scale sensor 19, and this value enables the MPU 21 to recognize the current position of the carriage 10 (and hence the head 17). The PWM controller 22 outputs the PWM waveform signal from a PWM output terminal 23 under control of the MPU 21 to drive the suction fan 11 (in this case, DC motor) via a driving transistor 24. The output from the medium sensor 18 described above is input to an input port of the MPU 21, and the MPU 21 monitors the sensor output.

Figure 3:
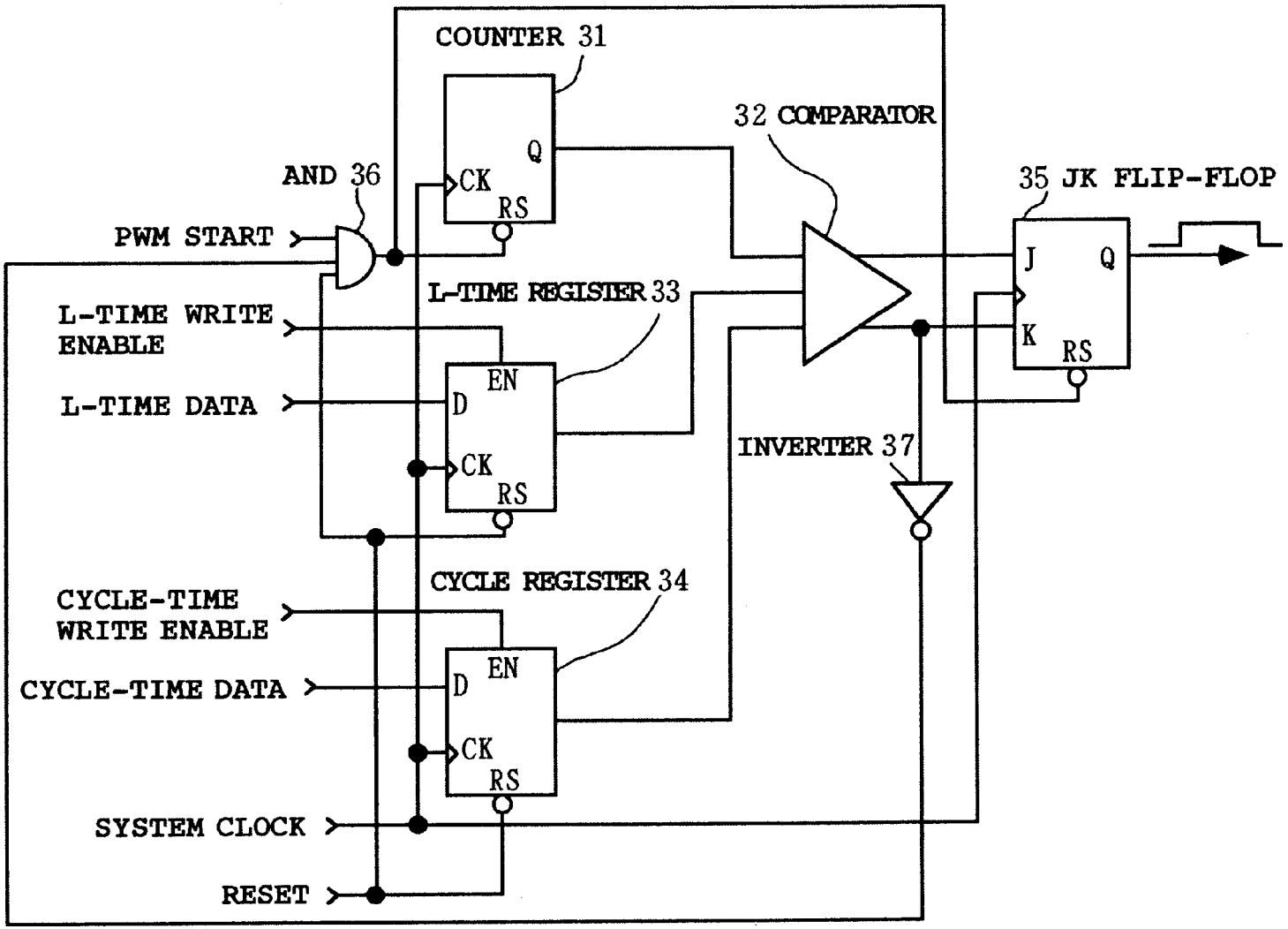
FIG. 3 is a circuit diagram showing a configuration example of the PWM controller shown in FIG. 2 that generates a PWM output signal.

FIG. 3 shows an example of the circuit configuration of the PWM controller 22 that generates the PWM output signal. The PWM controller 22, which comprises a counter 31, a comparator 32, an L-time register 33, a cycle register 34, a JK flip-flop 35, an AND gate 36, and an inventor 37, generates the PWM signal according to the sequence described below.

Initially, the MPU 21 sets PWM duty-factor data. That is, the MPU writes a cycle time and an L (low) level time (L-time) of one cycle of the PWM output signal, which are obtained in advance, into the L-time register 33 and the cycle register 34 in the PWM controller 22, respectively. More specifically, the MPU sets the L-time data in the L-time register 33, sets the L-time write-enable signal to the H (high) level, and loads the L-time data in the L-time register 33 in synchronization with the system clock. The MPU performs the same operation for the cycle register 34.

Next, when the MPU 21 sends the PWM start signal to the counter 31 in the PWM controller 22 (i. e. switches the signal level from L to H), the counter 31 is activated to start the PWM output operation. The comparator 32 compares the value in the counter 31 with the value in the L-time register 33 and, when hey match, the upper output of the comparator 32 in the figure s set to the H level. This H signal is input to the J side input of the JK flip-flop 35 that follows. In response to the B signal, the PWM output signal, which is the output of the JK flip-flop 35, is switched from L level to H level. In addition, the comparator 32 compares the value in the counter described above with the value in the cycle register 34 and, when they match, the lower output of the comparator 32 is set to the H level. This H signal is input to the K side input of the JK flip-flop 35. This switches the PWM output signal, which is output from the JK flip-flop 35, from H level back to L level. One cycle of the PWM output signal is generated in this manner. The H signal from the lower output of the comparator 32 is inverted by the inventor 37 and is input to the AND gate 36 as the L signal. This resets the counter 31 and the JK flip-flop 35. When the counter 31 is reset, the lower output of the comparator 32 returns to the L level and, via the inventor 37, the H signal is fed back to the AND gate 36. This causes the reset signal, which will be sent to the counter 31, to go back to the H level and causes the counter 31 to restart counting beginning with 0. In this way, the PWM waveform signal is output repeatedly with a predetermined duty-factor.

In order to change the PWM duty-factor, the PWM start signal is once returned to the L level and, with this state, the L-time register 33 and the cycle register 34 are sequentially rewritten.

Note that the system clock used in the circuit shown in FIG. 3 need not be the system clock itself but may be a signal generated by dividing the system clock.

Figure 4:
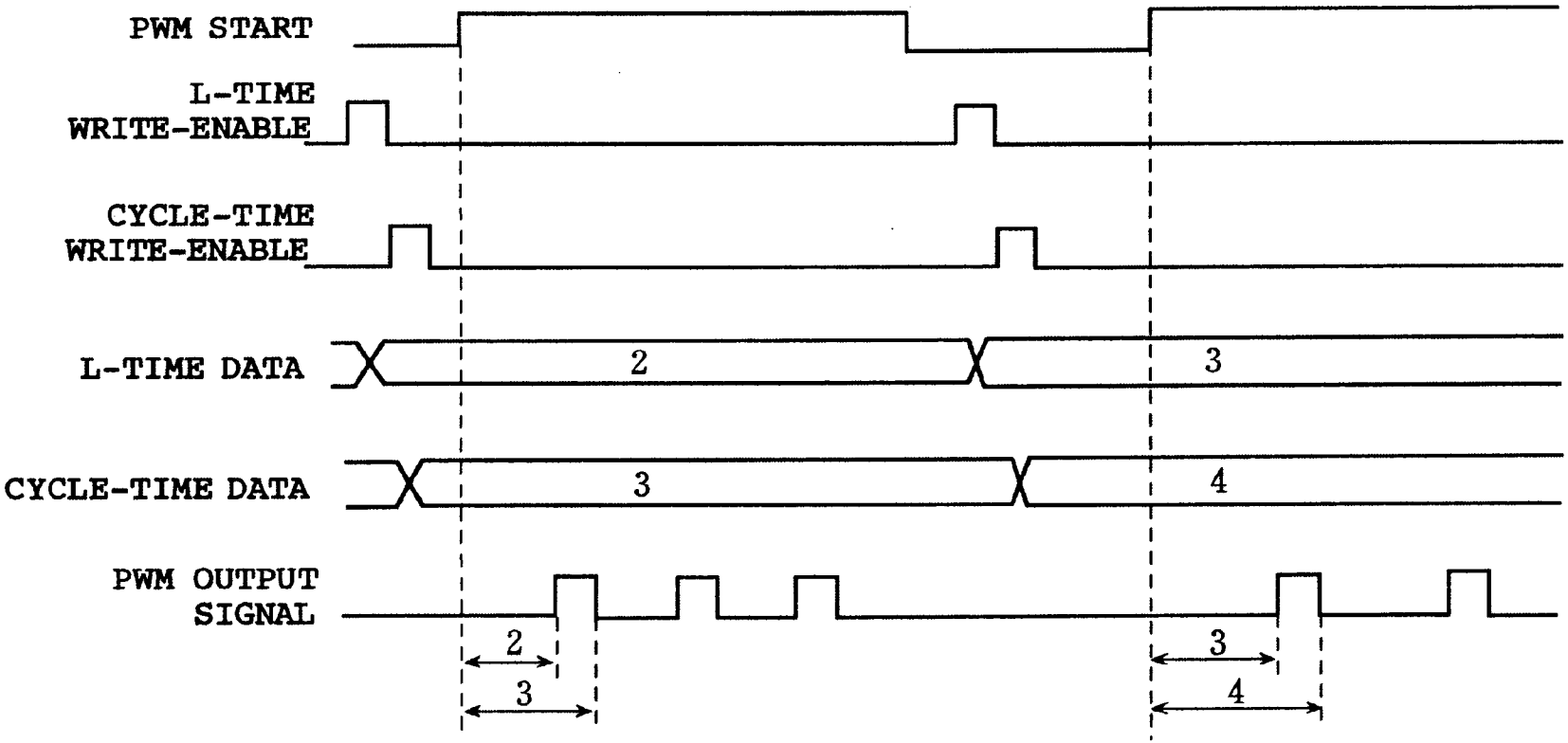
FIG. 4 is a timing diagram, for PWM waveform generation, showing the signal waveforms of the components of the circuit shown in FIG. 3.

FIG. 4 shows a timing diagram, for PWM waveform generation, showing the signal waveforms of the components of the circuit shown in FIG. 3. In this illustrated example, the PWM waveforms of the cycle time data "3" and the L-time data "2" are generated repeatedly, followed by the waveforms of the cycle time data "4" and the L-time data "3".

In this embodiment, the airflow amount of the suction fan is changed between the time when the head 17 is in the image region (print time) and the time when the head is outside the image region (non-print time). To do so, while the carriage 10 travels, the MPU 21 needs to recognize the boundary points of the region to dynamically set the L-time data (and cycle time data) in the PWM controller 22. There are various methods for recognizing the boundary points. One example will be described below. Unless otherwise stated, the airflow amount of the suction fan refers, in this specification, to the amount of airflow produced by the suction fan when the sheet of paper 14 is not on the platen 12 or when a predetermined reference sheet is on the platen 12 (a flow-path open/close unit mentioned below is not in the airflow amount path). This airflow amount corresponds to the suction force.

In this embodiment, controlling the variable and dynamic control of the suction fan reduces power consumption and, at the same time, reduces the conveyance load during the paper conveyance (when the head is outside the image region). Because a paper travelling could occur during a carriage movement in the printing operation (i. e. one band of paper is conveyed during carriage deceleration), the power consumption usually becomes the maximum at that time. Minimizing the power consumption of the fan motor during paper conveyance reduces the average power consumption of the device and, therefore, reduces the maximum power consumption.

Figure 5:
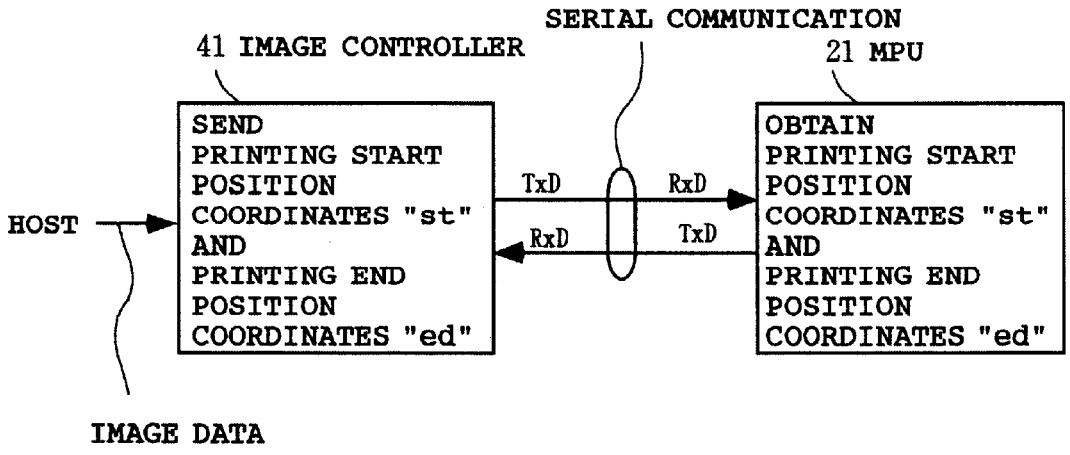
FIG. 5 is a simple block diagram showing the configuration for recognizing an image region in a first embodiment of the present invention.
Figure 6:
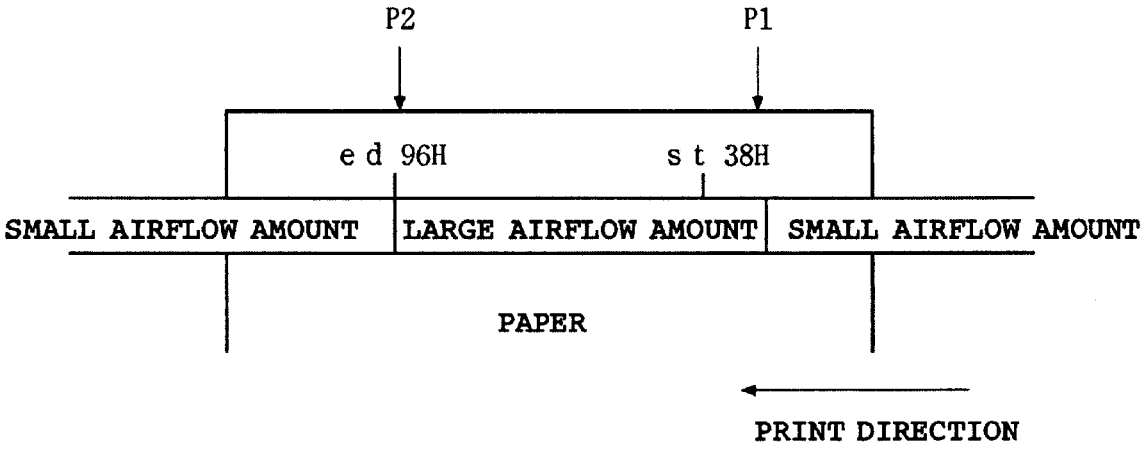
FIG. 6 is a diagram showing a result of the fan-airflow-amount control in the first embodiment of the present invention.

FIG. 5 is a simple block diagram showing the configuration in which the image region is recognized in this embodiment, and FIG. 6 shows the result of the control of fan-airflow amount.

The image region may be recognized by any known method. One of the methods will be described below conceptually and simply. The printer includes an image controller 41 that converts image data, received from the host device, into data printable on the printer. This image controller 41 analyzes the image data, recognizes the image area (printing start position coordinates "st" and printing end position coordinates "ed") for each band, and sends this image region information to the MPU 21 via serial communication. Upon receiving the image region information, the MPU 21 increases the PWM duty-factor for driving the suction fan when the head reaches a point immediately before the printing start position coordinates "st" (in this example, 38H), that is, a predetermined position (point P1 in FIG. 6) in the upstream side in the head travelling direction, in order to increase the fan-airflow amount. This increases the suction force of the suction fan 11 when the head enters the printing start region. This is to consider the time lag after the PWM duty-factor has been switched till the time the fan airflow actually changes.

After that, when the head reaches the printing end position coordinates "ed" (96H in this example, position P2 in FIG. 6), the PWM duty-factor is decreased to reduce the fan-airflow amount. When reducing the airflow amount, there is no need for considering the time lag for changing the fan-airflow amount. The PWM duty-factor settings, prestored in the ROM 25, are read from the ROM 25 during the PWM setting.

Before printing one band of data, the MPU 21 first requests the image controller 41 to send the printing position coordinates "st" and "ed" (S11). In response to this request, the image controller 41 sends the printing position coordinates "st" and "ed" back to the MPU 21. The MPU 21 receives them (S12). Then, the MPU starts moving the head 17 (S13). After that, the MPU checks if the linear scale value has reached a predetermined value (in this example, ("st" value−(minus) 10H)) associated with the printing start position coordinates "st" (S14). When the linear scale value has reached the predetermined value, the MPU increases the PWM duty-factor (S15). Then, the MPU checks if the linear scale value has reached a predetermined value (in this example, "ed" value) associated with the printing end position coordinates (S16). When the linear scale value has reached the latter predetermined value, the MPU resets (decreases) the PWM duty-factor (S17). The operation described above is repeated for each band.

There are a lot of types of paper (media) each with its own characteristics such as paper density and elasticity. Because of the difference in paper characteristics, one type of paper could rise while another type of paper is satisfactorily sucked even if the number of rotations of the suction fan is the same. To solve this problem, the airflow amount of the suction fan is optimized according to the type of paper in a second embodiment of the present invention that will be described below.

Figure 2:
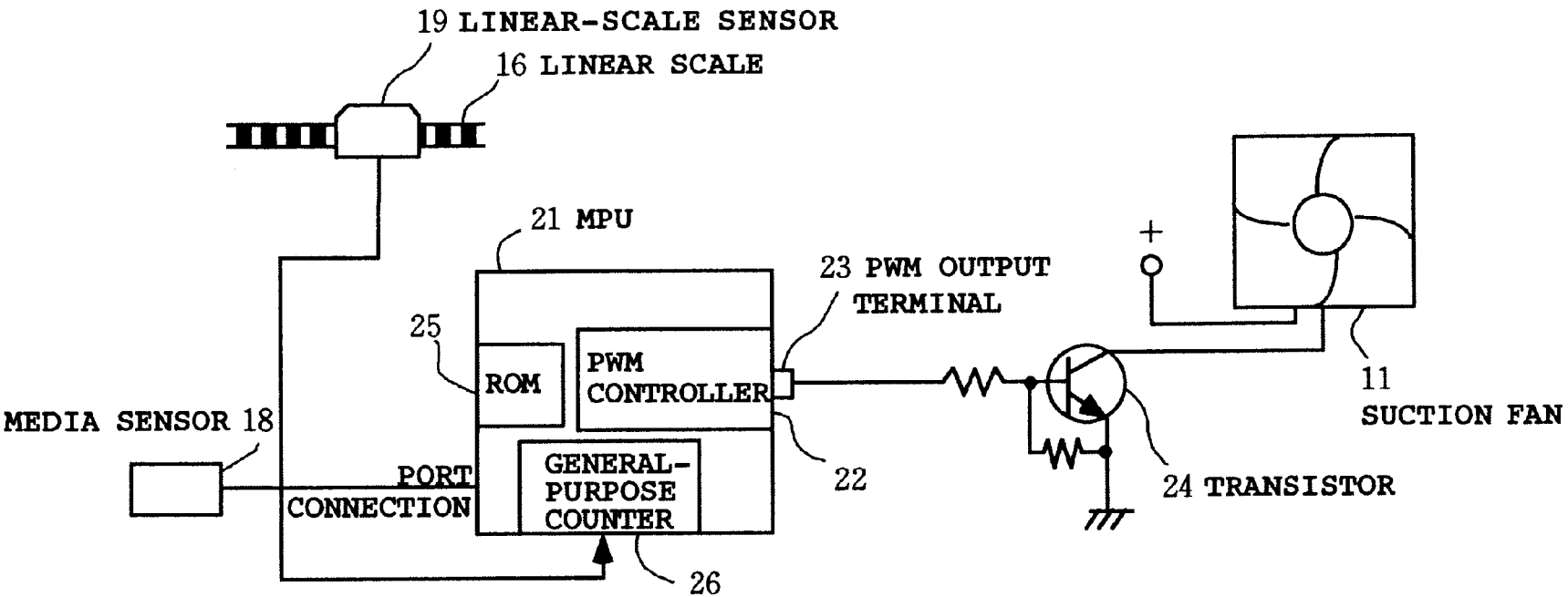
FIG. 2 is a diagram showing the control configuration of the suction fan of the printer shown in FIG. 1.

The configuration of a printer in this embodiment is the same as that shown in FIG. 1, and the control configuration of the suction fan 11 is the same as that shown in FIG. 2.

Many types of means for detecting the media type have been devised. For this means, any one of known means may be used. In this embodiment, it is assumed that a user specifies one of the media through the operation panel.

Figure 8:
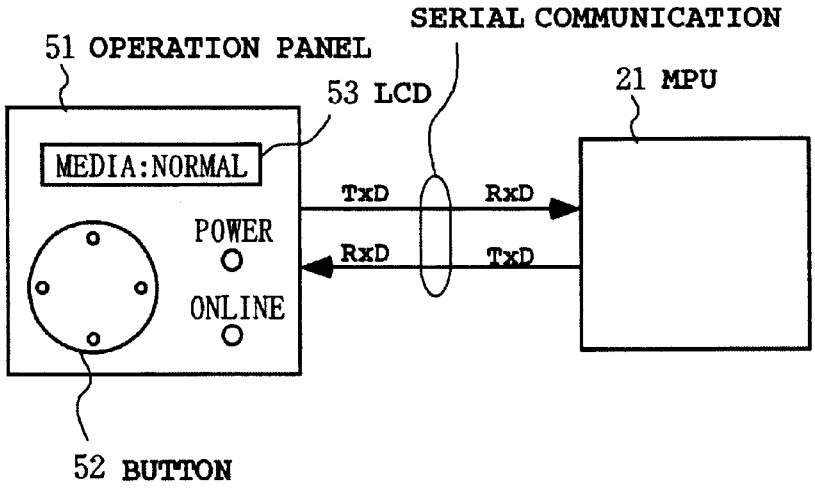
FIG. 8 is a block diagram showing a printer part in a second embodiment of the present invention.

FIG. 8 shows the block diagram of a printer part in the second embodiment. The user enters (selects) a media type by an operation of, for example, a key 52 on an operation panel 51. The selected result is displayed on an LCD (liquid crystal display) 53.

Figure 9:
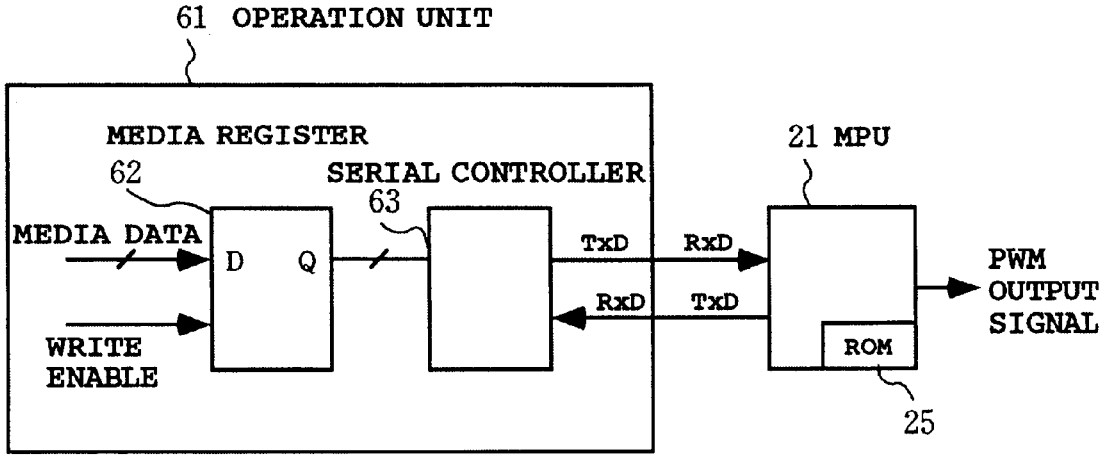
FIG. 9 is a block diagram showing the configuration of a part relating to the second embodiment of the present invention.

As shown in FIG. 9, as the user performs operation on the operation panel 51, the entered media data is written in a media register 62 located in an operation unit 61 of the printer. This media data is sent to the MPU 21 via a serial controller 63. The media data is data pre-coded for each media type (such as, 01H=plain paper). The MPU 21 requests and receives data stored in the media register 62 as necessary via serial communication to check what media type has been specified. Then, the MPU 21 reads PWM duty-factor data (for example, cycle time data and L-time data) corresponding to the media type from the ROM 25 and makes the setting of the PWM controller 22 as described above in order to control the airflow amount.

FIG. 10 shows an example of duty-factor data for each media type stored in the ROM 25. The cycle time data and the L-time data for each media type are stored in a predetermined address in the ROM 25. The optimum settings may be obtained empirically and experimentally for each media type.

Figure 11:
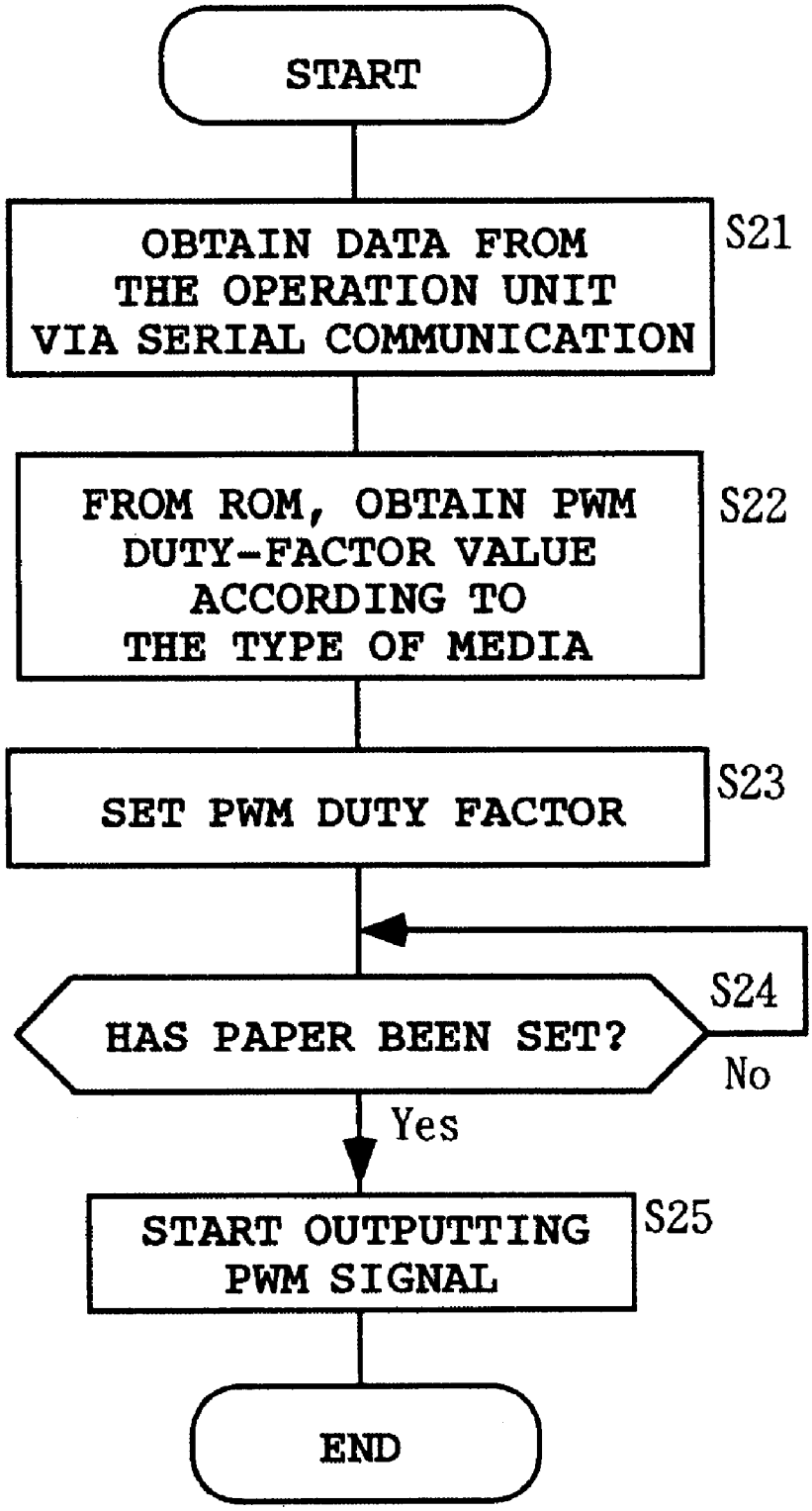
FIG. 11 is a flowchart showing how the fan-airflow amount is controlled in the second embodiment of the present invention.

FIG. 11 is a flowchart showing the processing of the second embodiment.

First, the MPU 21 obtains user-entered media data from the media register 62 in the operation unit 61 via serial communication (S21). Then, the MPU reads PWM duty-factor data from an address in the ROM 25 corresponding to this media data (S22). The MPU sets the PWM duty-factor for the PWM controller 22 (S23) as described above. Then, the MPU checks the output of the medium sensor 18 to see if the paper has been set (S24) and starts outputting the PWM signal (S25). As described above, the device in the first embodiment controls the fan-airflow amount depending upon whether or not the head is in the image region to reduce the fan power requirement and the conveyance motor load, and therefore to generally reduce power consumption and noise. On the other hand, the device in the second embodiment variably changes and optimizes the fan power according to the media type to reduce power consumption and noise.

Although the first embodiment and the second embodiment have been described as independent embodiments, they could be combined with each other. That is, the base value (for example, the minimum airflow amount) of the suction-fan-airflow amount may be determined according to the media type to allow the suction fan to run freely and, in the image region, the airflow amount may be variably changed to a satisfactory amount that does not cause a paper rise.

Figure 12:
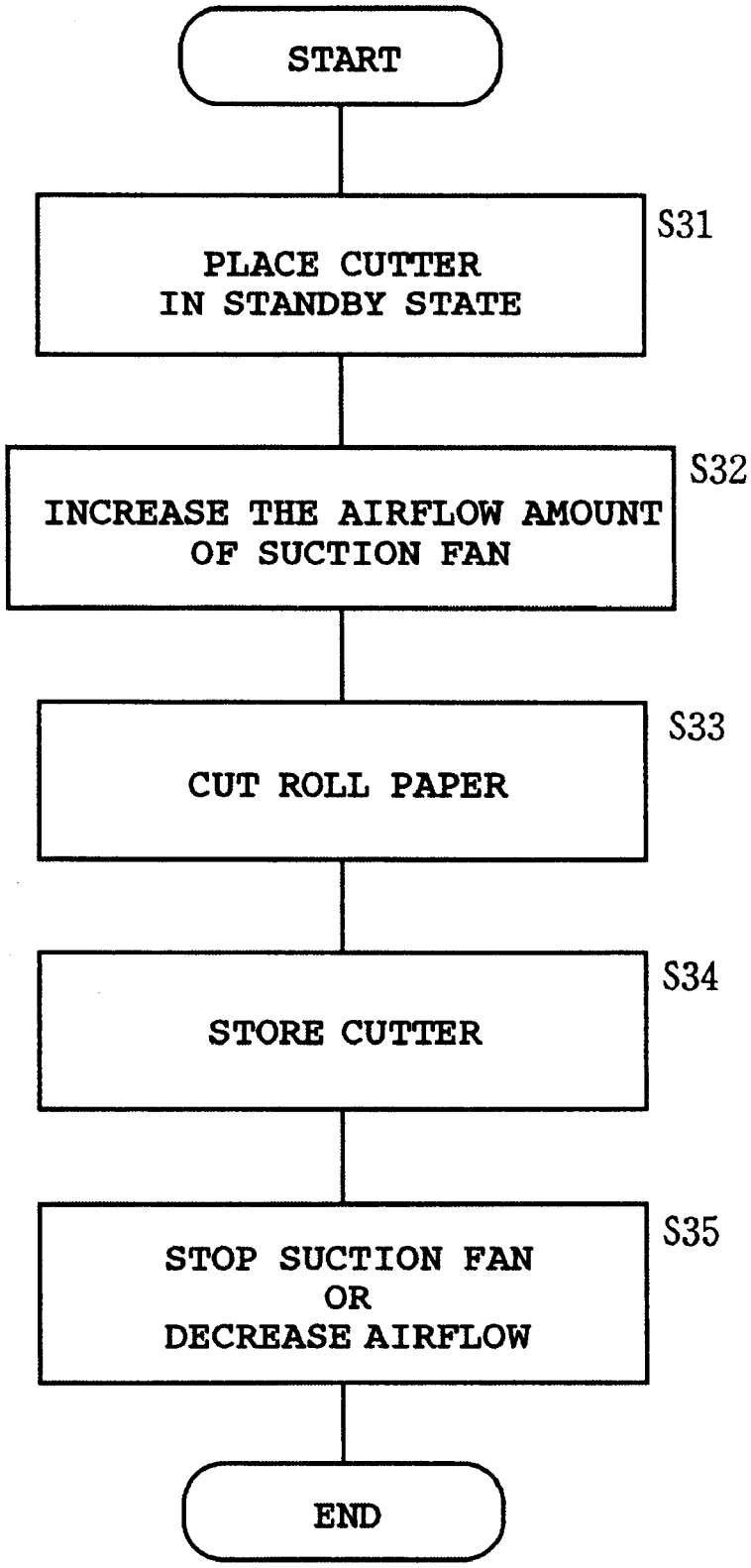
FIG. 12 is a flowchart showing a third embodiment of the present invention.
Figure 14:
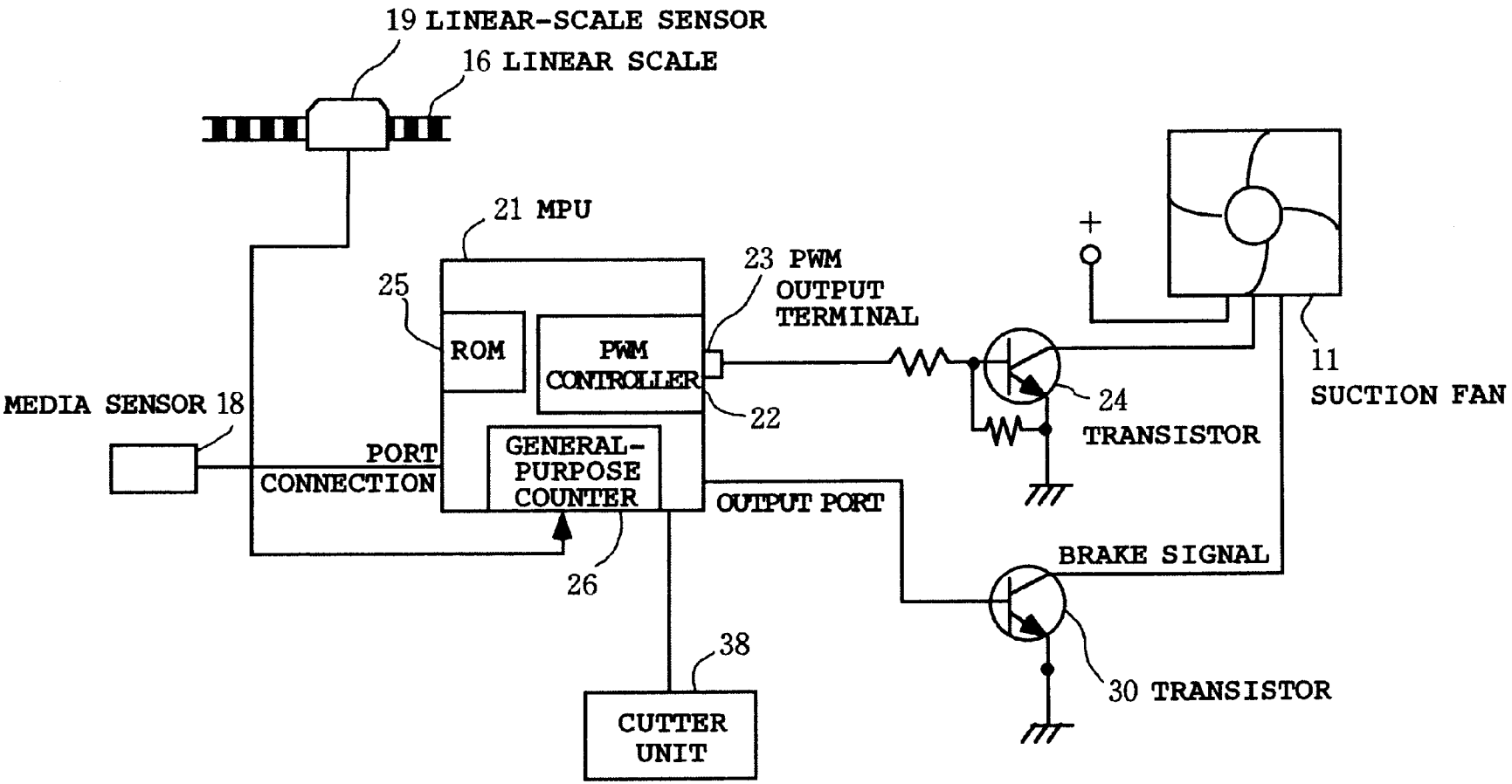
FIG. 14 is a diagram showing the control configuration of the suction fan in the third and fourth embodiments of the present invention.

Next, a third embodiment will be described with reference to FIG. 12. As shown in FIG. 14, this embodiment relates to an image forming device with a cutter unit 38 that, when a roll paper is used as the print medium, cuts the roll paper into a sheet of paper with a desired length. The cutter unit 38 is controlled by the signal from an output port of the MPU 21.

Depending upon the type of roll paper, especially when the roll paper is thin, a cut-time jam could occur because the paper may not be cut properly during the cut operation. In this case, retaining the roll paper onto the platen more tightly may prevent a cut-time jam. In this embodiment, the device supplies the amount of airflow at a cut time larger than that at a print time.

That is, after one page of image data has been printed, a part of the print medium to be cut is moved immediately below the cutter unit 38 to enter the cut sequence. FIG. 12 shows a processing example of this cut sequence. First, in a cut standby (S31) state, the airflow amount of the fan is made larger than that of the fan at the print time (S32). Then, the cutter unit 38 cuts the roll paper (S33). After that, the cutter unit 38 is stored in a predetermined position (S34) and the suction fan is stopped or caused to decrease the airflow amount (S35). The degree of the large airflow amount in step S32 may be determined according to the type of roll paper (paper thickness, paper nature, and so on).

Figure 13:
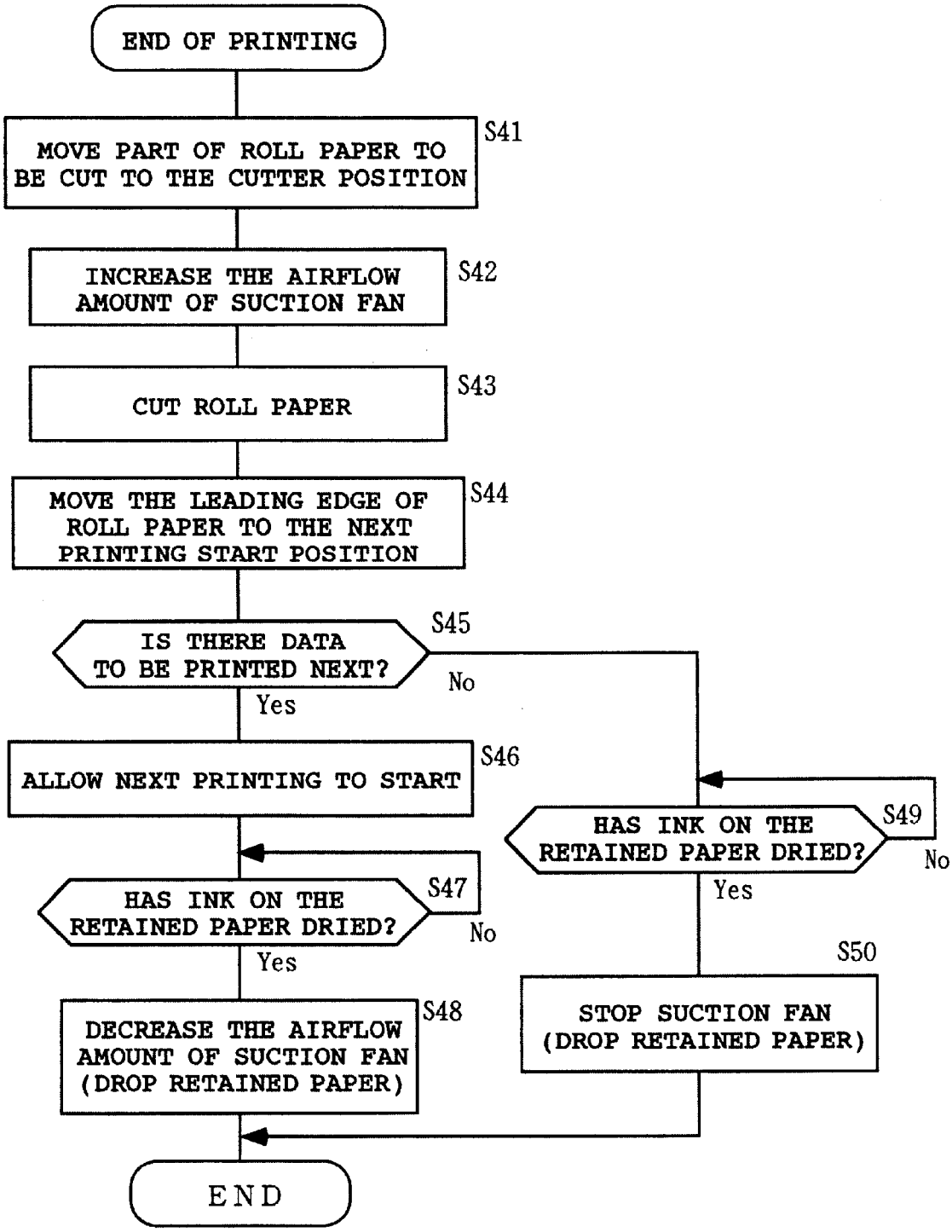
FIG. 13 is a flowchart showing a fourth embodiment of the present invention.

Next, a fourth embodiment of the present invention will be described with reference to the flowchart in FIG. 13 which shows a processing executed when a printing ends. Normally, a roll paper that has been cut is dropped into, and stored in, a printed-paper stacker (or a basket) (not shown in the figure). However, a roll paper, if cut immediately after the completion of printing, may be stained with other objects or a human's hand because the ink is still wet. To prevent this, the cut operation is conventionally performed after a predetermined dry time has elapsed. As a result, when successively printing one page after another, the start of printing of the next page is delayed. In this embodiment, the roll paper is cut immediately after a printing has been finished and, after the cutting, the leading edge of the roll paper is moved to the next print starting position while retaining the already-cut sheet of paper on the platen under control of the suction fan. After the dry time has elapsed, the suction fan is stopped or caused to decrease the airflow amount to release the already-cut sheet of paper and then to drop it into the stacker or some other box.

More specifically, the part of the roll paper to be cut is first moved immediately below the cutter unit 38 after the printing as shown in the example of processing procedure in FIG. 13 (S41). Then, the suction fan is driven (for example, the fan sucks paper.at full capacity) to produce an amount of airflow large sufficient to suck and retain the sheet of paper that was cut off from the roll paper (S42). The roll paper is cut in this state (S43). At this time, the sheet of paper cut off from the roll paper, which is retained with suction force, does not drop into the stacker. Then, the leading edge of the roll paper is moved (returned) to the next printing start position without changing the airflow amount of the suction fan, that is, the roll paper is put in the standby position for the next printing (S44). Although the roll paper conveyance load is increased during this particular movement of the roll paper, this state lasts only a short period of time.

Then, a check is made to see if there is data to be printed next (S45). If it is present, the next print operation is allowed to start before the dry time elapses to the extent that there is no effect on the retained sheet of paper (S46). When the ink-drying time of the retained sheet of paper has elapsed (S47), the airflow amount of the suction fan is decreased (S48) to drop and store the retained sheet of paper into the stacker or some other box. If there is no data to be printed next and when the ink-drying time of the retained sheet of paper has ended (S49), the suction fan is stopped and the retained sheet of paper is dropped into, and stored in, the stacker or some other box (S50).

Next, referring to a timing diagram shown in FIG. 15, a fifth embodiment of the present invention will be described. In this embodiment, a drive element (transistor) 30 is provided as a brake means of the suction fan 11 as shown in FIG. 14. This drive element 30 brakes the motor of the suction fan 11 under control of the signal from the output port of the MPU 21. The brake operation of the motor may be implemented by any known means.

Figure 15:
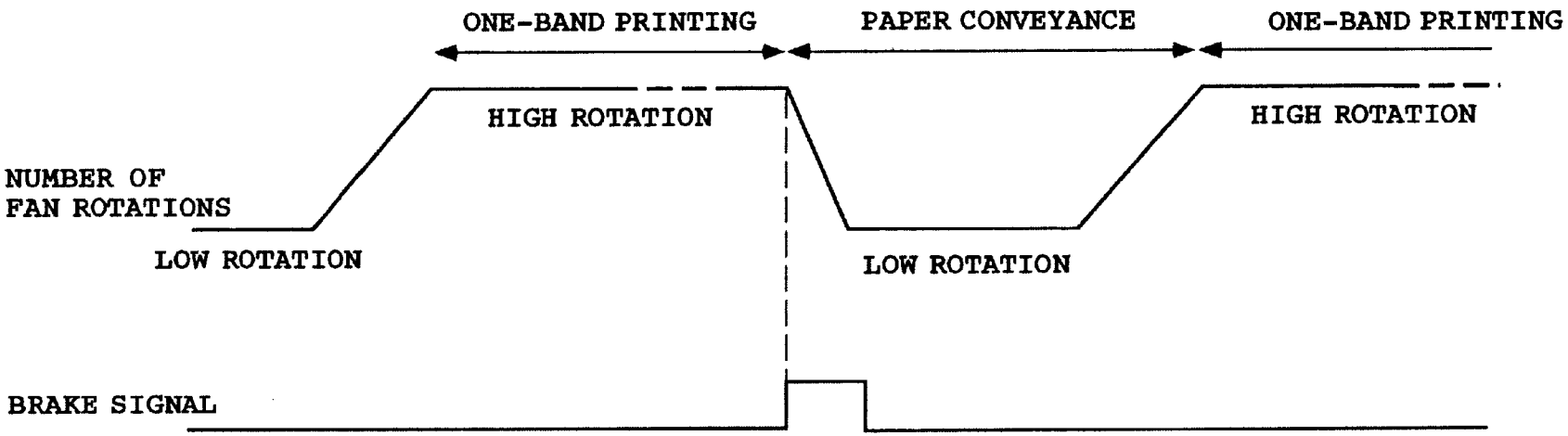
FIG. 15 is a timing diagram illustrating a fifth embodiment of the present invention.
Figure 16:
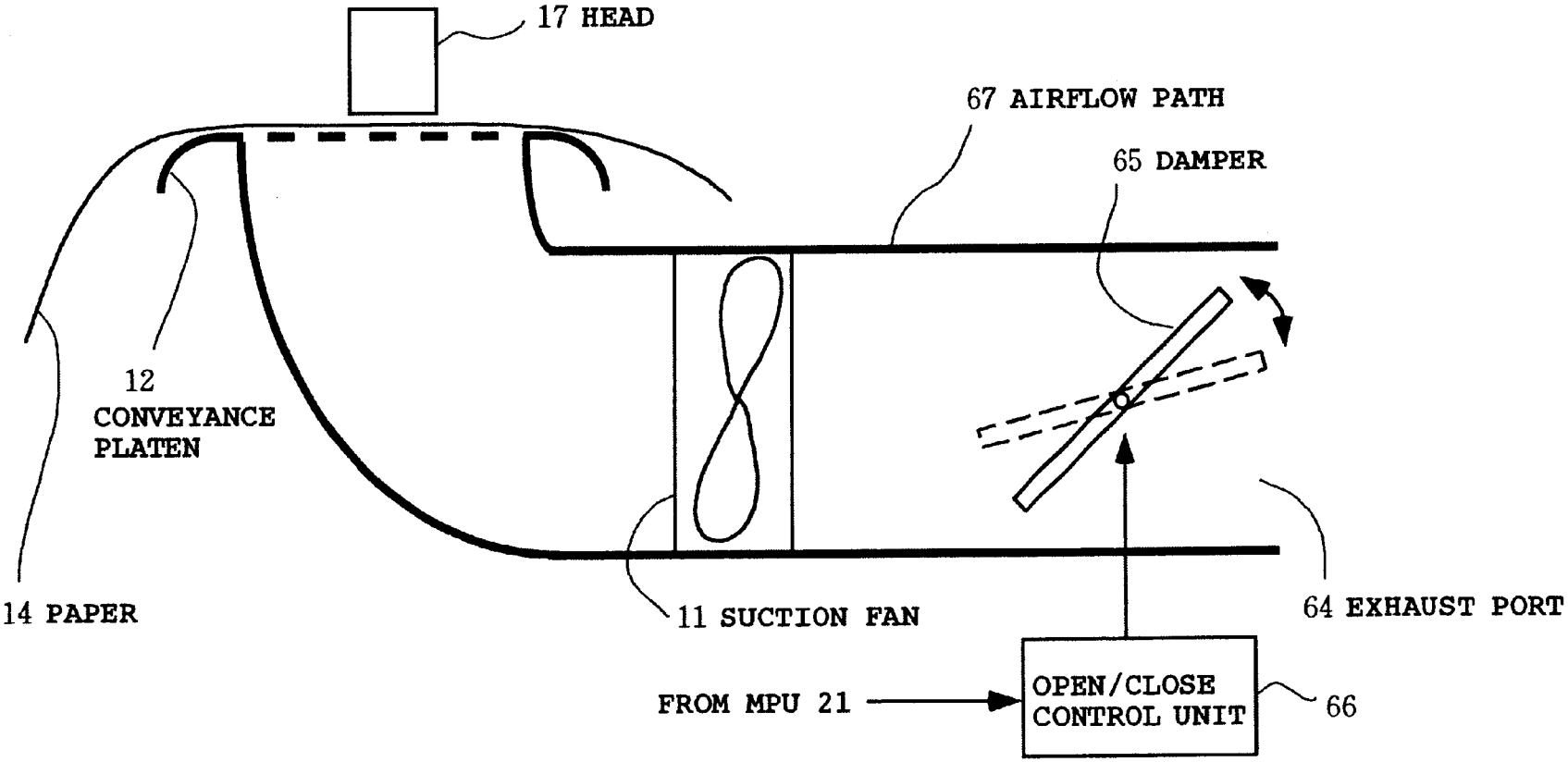
FIG. 16 is a diagram showing the outline configuration of the main components for illustrating a sixth embodiment of the present invention.

As shown in FIG. 15, during a print processing in which one band of printing and one band of paper conveyance are alternated, the number of fan rotations is increased during one-band printing (large airflow amount) while the number of fan rotations is decreased during paper conveyance (small airflow amount). This reliably makes paper flat during the printing operation and, at the same time, reduces the conveyance load during the paper conveyance. The brake control with or instead of the PWM control is used in this embodiment especially when the number of fan rotations is dropped from high to low. This makes the airflow-amount variable control more responsive. Although, in the second embodiment explained above, the fan-airflow amount was changed according to the print region even during one-band print scanning, this embodiment does not need to change the fan air-flow amount according to the print region. Next, referring to FIGS. 16, 17, and 18, a sixth embodiment of the present invention will be described. FIG. 16 shows the overview of the major components of this embodiment. In the embodiments described above, the number of rotations of the suction fan 11 is controlled to control the airflow amount of the suction fan 11. However, to achieve the objects of the present invention, the number of rotations of the suction fan 11 need not necessarily be changed; instead, it is sufficient simply to adjust the amount of airflow in the airflow path produced by the suction fan 11. The "airflow amount" in this context refers to the actual airflow amount in the flow path that is not related to the presence or absence of paper on the platen or the type of paper. In this embodiment, means is provided to change the airflow amount in the flow path without changing the number of rotations of the suction fan 11. A change in airflow amount in the flow path changes the suction force of the suction fan 11. Also, in this embodiment, the suction fan 11 may be turned on or off as necessary. In addition, the control of the number of rotations of the suction fan 11 may be combined with the airflow amount control in the flow path. In FIG. 16, the suction fan 11 has an airflow path 67, extending from the bottom of the conveyance platen 12 to an exhaust port 64, with the suction fan 11 disposed in this flow path. Provided in the airflow path 67 is a damper (flow-path open/close unit) 65 that is located near the exhaust port 64 in the downstream side of the suction fan 11 and that rotates about the rotation axis extending across the airflow path 67 to open or close the airflow path 67. The damper 65 is opened or closed by an open/close control unit 66 under control of the MPU 21. Although the damper 65 shown in the figure is a rotation driven 25 type, a damper that is linearly inserted into, or removed from, the flow path may also be used.

The embodiment in which the damper 65 is used may be combined with most of the other embodiments. For example, instead of the processing of the first embodiment shown in FIG. 7, the processing shown in FIG. 17 may be used.

Figure 7:
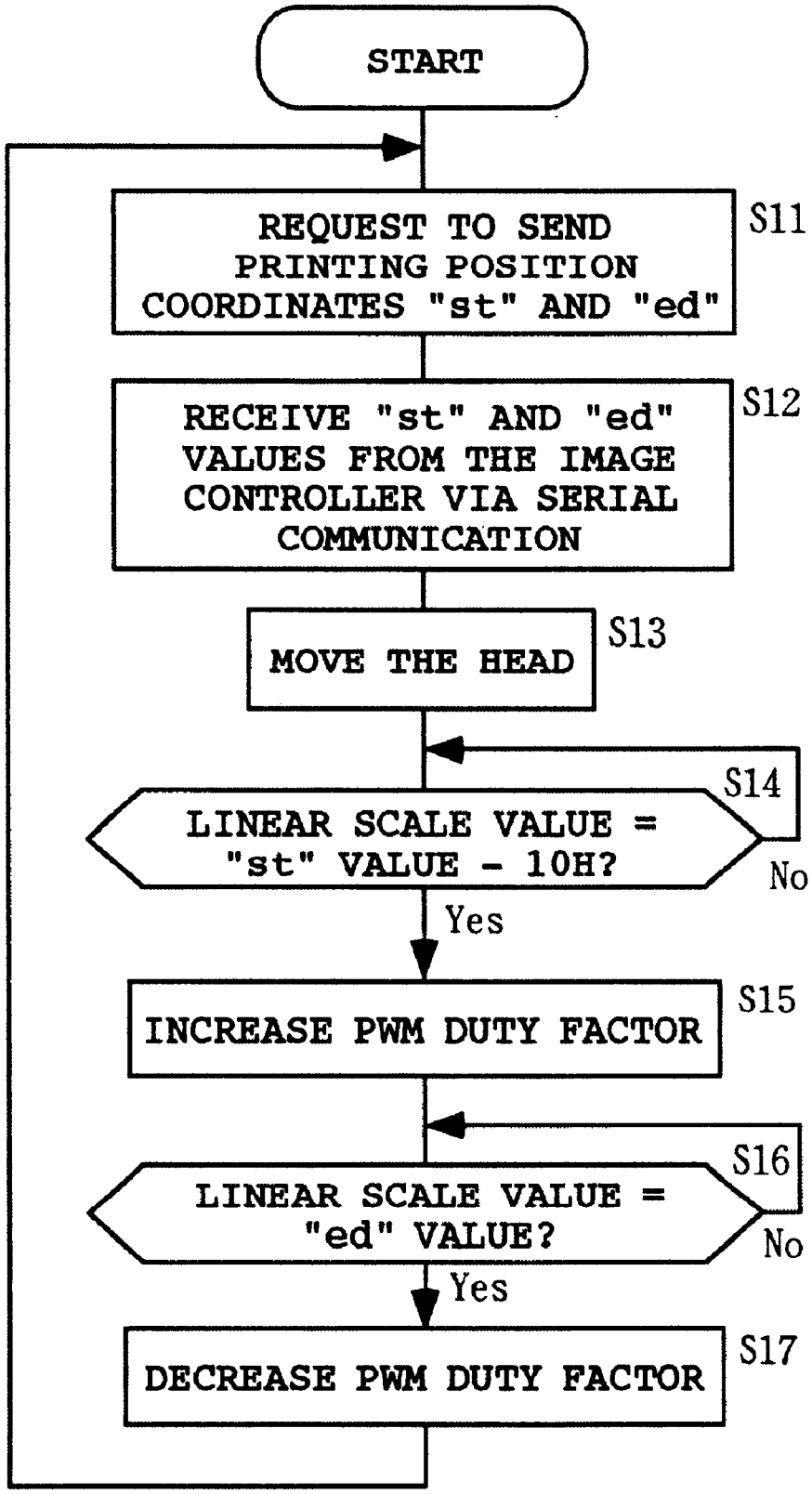
FIG. 7 is a flowchart showing how the fan-airflow amount is controlled in the first embodiment of the present invention.
Figure 17:
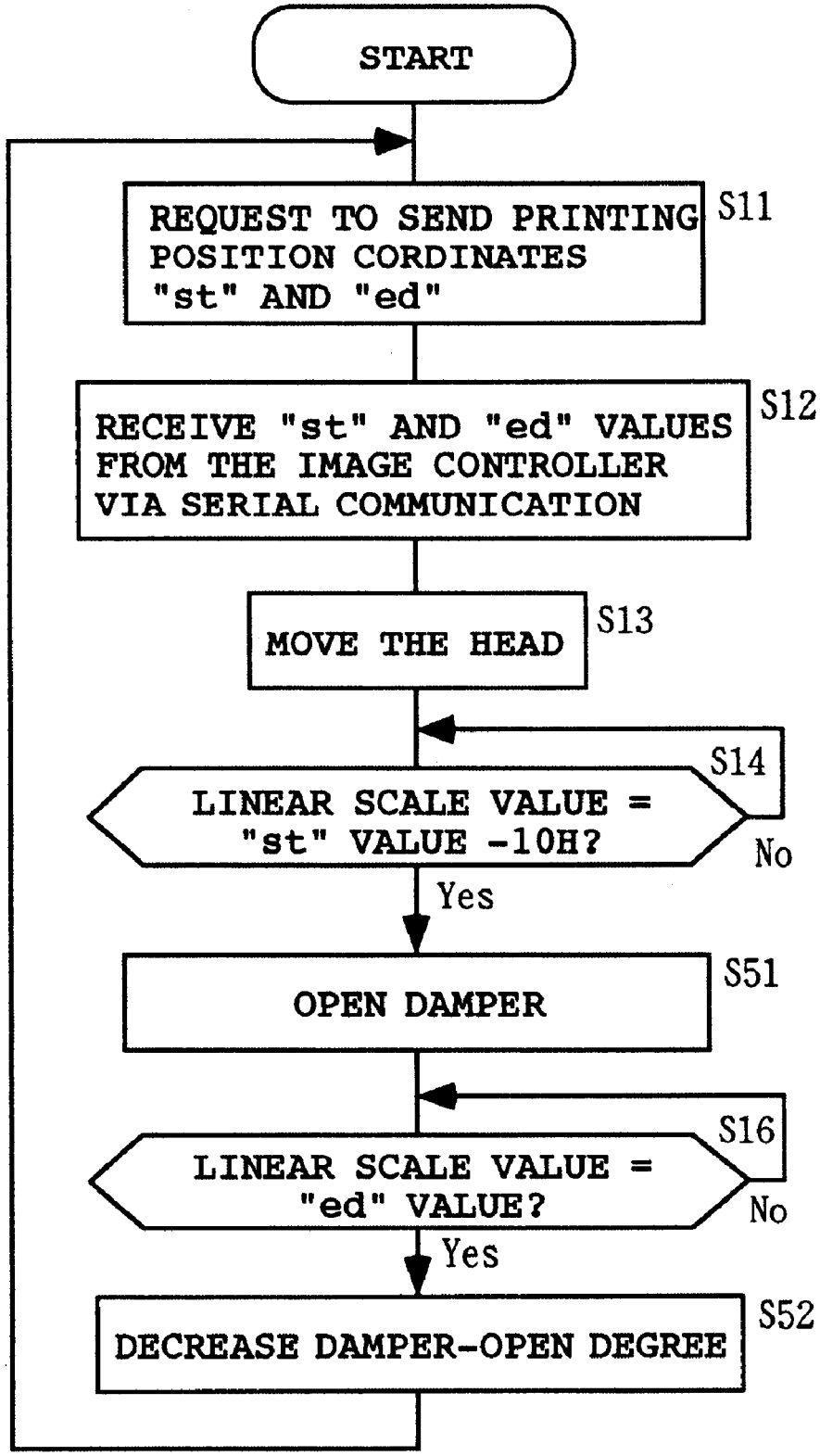
FIG. 17 is a flowchart showing how the first embodiment is controlled with the flow-path open/close unit shown in FIG. 16.

In the flowchart shown in FIG. 17, the same reference numerals are attached to the same steps as those in FIG. 7 and only the different points are described below. In the processing in FIG. 17, the damper is opened (S51) instead of step S15 in which the PWM duty-factor is increased. Similarly, the damper open degree is decreased (S52) instead of step S17 in which the PWM duty-factor is decreased. Other steps are the same as those in FIG. 7.

Figure 18:
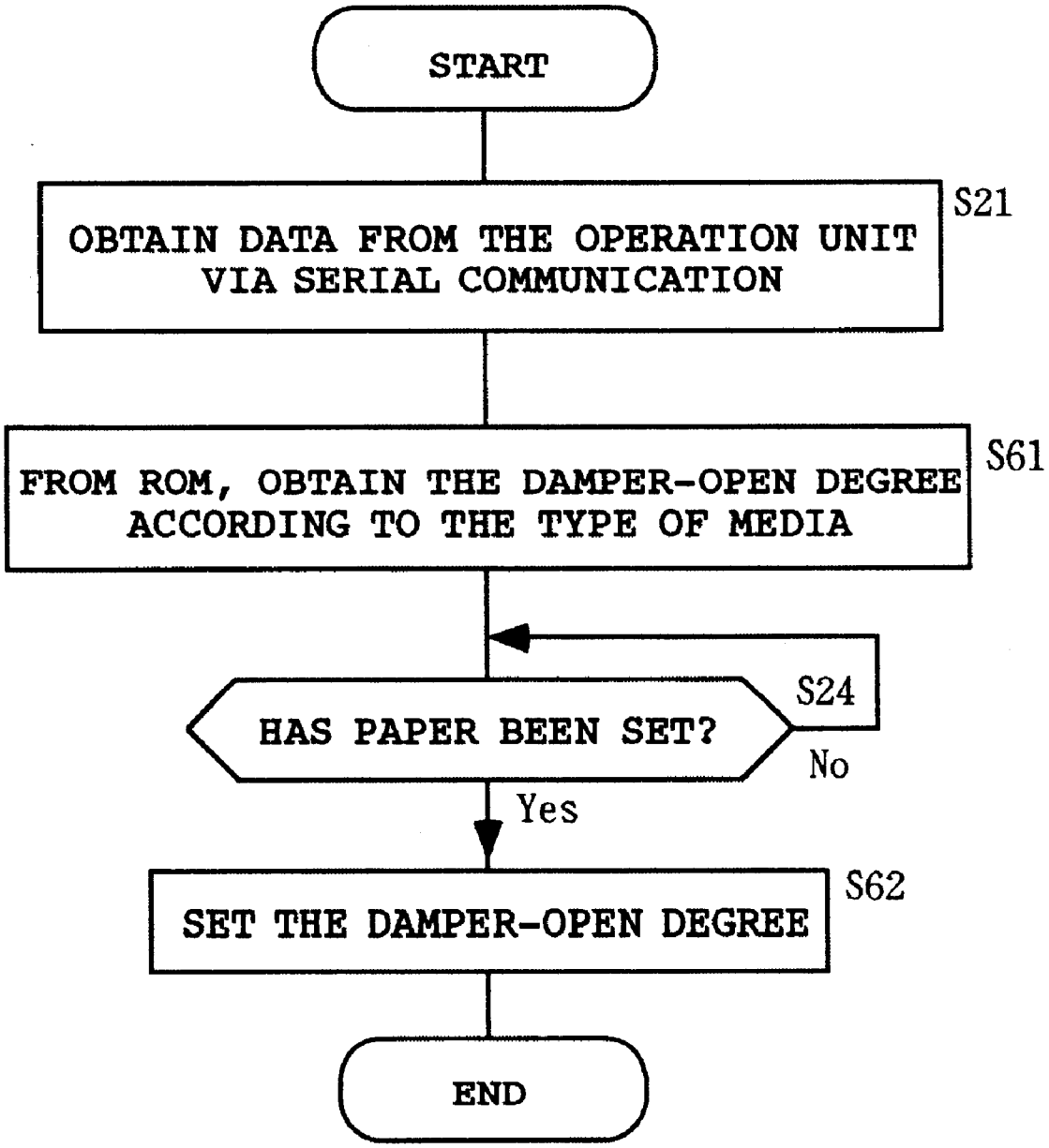
FIG. 18 is a flowchart showing how the second embodiment is controlled with the flow-path open/close unit shown in FIG. 16.

In this embodiment, instead of the processing of the second embodiment shown in FIG. 11, the processing shown in FIG. 18 may be used.

In the flowchart shown in FIG. 18, the same reference numerals are attached to the same steps as those in FIG. 11 and only the different points are described below. In the processing shown in FIG. 18, the damper open degree value according to the media is obtained (S61) instead of steps S22 and S23 in which the PWM duty-factor value according to the media is obtained and set. Then, the damper open degree is set instead of step S25 in which the PWM output is started (S62). Other steps are the same as those in FIG. 11.

While the preferred embodiments of the present invention have been described, it is to be understood that modifications and changes may be made without departing from the spirit and scope of the claims of the present invention. For example, although, in the above description, data may be printed by the head moving in one direction only, the present invention may be applied also to bi-directional printing. In addition, although the PWM control is used to control the suction fan motor, any technology capable of variably controlling the number of fan motor rotations may be used. Moreover, both the cycle time and the L-time are changed to change the PWM duty-factor, only one of them may be changed. Although it was stated above that some embodiments may be combined with each other, another combination of the above-described embodiments may be made unless they conflict with each other.

Industrial Applicability

The present invention finds applications in the design, development, and manufacturing of an ink-jet type image forming device. This invention allows an ink-jet type image forming device to adjust the suction force of the fan according to the situation, reduces the fan power requirement and therefore reduces the conveyance motor load, and generally reduces power consumption and noise.

What is claimed is:

1. An ink-jet type image forming device which ejects ink from a print head onto a print medium being conveyed on a platen to form an image, said head being scanned in a direction substantially at a right angle with a direction in which the print medium is conveyed, said device comprising:

a suction fan for sucking the print medium from below the variable-control means for variably controlling a suction force of said suction fan; and printing means for performing a one-band printing according to one scan of said print head;

said variable-control means dynamically controlling the suction force of said suction fan during a period of time of one scanning of said print head.

2. The ink-jet type image forming device according to claim 1, wherein said variable-control means includes a number-of-rotation control means for variably controlling a number of rotations of said suction fan.

3. The ink-jet type image forming device according to claim 1, wherein said variable-control means is implemented by using a flow-path open/close unit disposed in a flow path of air sucked by said suction fan and capable of opening/closing said flow path at a variable open degree.

4. The ink-jet type image forming device according to claim 1, wherein said variable-control means includes means for checking, during each head scanning, whether or not said head is within a print region ranging from a printing start position to a printing end position, and wherein the suction force of said suction fan is controlled in such a way that the suction force of said suction fan exerted when said head is outside the print region is made lower than the suction force exerted when said head is in the print region.

5. The ink-jet type image forming device according to claim 1, 2, 3, or 4 wherein said variable-control means includes means for recognizing a type of the print medium that has been set, and wherein the suction force of said suction fan is controlled according to the type of the recognized print medium.

6. The ink-jet type image forming device according to claim 1, 2, or 3, wherein said image forming device includes a cutter unit for cutting a roll paper used as the print medium, and wherein said variable-control means performs a control such that the suction force of said fan exerted when the roll paper is cut by said cutter unit is made larger than that exerted when one band of printing is being performed by the scanning of said head.

7. The ink-jet type image forming device according to claim 6, wherein said variable-control means includes means for recognizing a type of the roll paper, and wherein the suction force of said suction fan is controlled according to the type of the recognized roll paper.

8. The ink-jet type image forming device according to claim 6, wherein said suction fan is rotated and controlled by a fan motor, wherein said image forming device includes a brake means for suppressing a rotation of said fan motor, and wherein said variable-control means uses said brake means to decrease the suction force of said suction fan.

9. The ink-jet type image forming device according to claim 1, 2, or 3, wherein said image forming device includes a cutter unit for cutting a roll paper used as the print medium and wherein said variable-control means maintains the suction force of the suction fan to be strong sufficient to retain a sheet of cut paper for a predetermined period of time even after said cutter unit has cut the roll paper and, after said predetermined period of time has elapsed, changes the suction force of the suction fan to such an extent that the sheet of cut paper drops.

10. The ink-jet type image forming device according to claim 9, wherein said image forming device includes a control means for moving a leading edge of the cut roll paper to a standby position for next printing immediately after said cutter unit has cut the print medium.

11. The ink-jet type image forming device according to claim 10, wherein said suction fan is rotated and controlled by a fan motor, wherein said image forming device includes a brake means for suppressing a rotation of said fan motor, and wherein said variable-control means uses said brake means to decrease the suction force of said suction fan.

12. The ink-jet type image forming device according to claim 1, wherein said image forming device repeatedly alternates between one-band printing by the scanning of said head and one-band conveyance of the print medium after the one-band printing; and wherein said variable-control means performs a control such that the suction force of said suction fan exerted when one band of printing is being performed by the scanning of said head is smaller than that exerted when the print medium is conveyed.

13. The ink-jet type image forming device according to claim 1, 2, 4, or 12, wherein said suction fan is rotated and controlled by a fan motor, wherein said image forming device includes a brake means for suppressing a rotation of said fan motor, and wherein said variable-control means uses said brake means to decrease the suction force of said suction fan.

* * * * *

UNITED STATES PATENT AND TRADEMARK OFFICE

CERTIFICATE OF CORRECTION

PATENT NO. : 6,604,820 B2 
DATED : August 12, 2003
INVENTOR(S) : Michitaka Fukuda It is certified that error appears in the above-identified patent and that said Letters Patent is hereby corrected as shown below:

Column 12,
Lines 23-32 should read:

12. The ink-jet type image forming device according to claim 1, wherein said image forming device repeatedly alternates between one-band printing by the scanning of said head and one-band conveyance of the print medium after the one-band printing; and wherein said variable-control means performs a control such that the suction force of said suction fan exerted when one band of printing is being performed by the scanning of said head is larger than that exerted when the print medium is conveyed.

Signed and Sealed this

Twelfth Day of April, 2005

JON W. DUDAS
*Director of the United States Patent and Trademark Office*

UNITED STATES PATENT AND TRADEMARK OFFICE

CERTIFICATE OF CORRECTION

PATENT NO. : 6,604,820 B1
APPLICATION NO. : 09/856570
DATED : August 12, 2003
INVENTOR(S) : Michitaka Fukuda It is certified that error appears in the above-identified patent and that said Letters Patent is hereby corrected as shown below:

Claim 1 (column 10, lines 53-67) should read as follows:

1. An ink-jet type image forming device which ejects ink from a print head onto a print medium being conveyed on a platen to form an image, said head being scanned in a direction substantially at a right angle with a direction in which the print medium is conveyed, said device comprising:

a suction fan for sucking the print medium from below the platen;

variable-control means for variably controlling a suction force of said suction fan; and printing means for performing a one-band printing according to one scan of said print head;

said variable-control means dynamically controlling the suction force of said suction fan during a period of time of one scanning of said print head.

Signed and Sealed this

Twenty-ninth Day of June, 2010

David J. Kappos

David J. Kappos
*Director of the United States Patent and Trademark Office*